US009746284B2

(12) United States Patent
McCarthy

(10) Patent No.: US 9,746,284 B2
(45) Date of Patent: Aug. 29, 2017

(54) QUICK CONVERSION SLING

(71) Applicant: Kevin McCarthy, Bend, OR (US)

(72) Inventor: Kevin McCarthy, Bend, OR (US)

(73) Assignee: Sly Tactical L.L.C., Windsor, CA (US)

( * ) Notice: Subject to any disclaimer, the term of this patent is extended or adjusted under 35 U.S.C. 154(b) by 0 days.

(21) Appl. No.: 14/683,972

(22) Filed: Apr. 10, 2015

(65) Prior Publication Data

US 2015/0292834 A1 Oct. 15, 2015

Related U.S. Application Data

(60) Provisional application No. 61/995,472, filed on Apr. 10, 2014.

(51) Int. Cl.
*F41C 33/00* (2006.01)

(52) U.S. Cl.
CPC .... *F41C 33/002* (2013.01); *A45F 2200/0591* (2013.01)

(58) Field of Classification Search
CPC ..... F41C 33/001; F41C 33/002; A45F 2005/1013; A45F 5/10; A45F 2200/0591; A45C 13/26; A45C 13/28
USPC ..... 16/110.1, 428; 224/150
See application file for complete search history.

(56) References Cited

U.S. PATENT DOCUMENTS 5,401,070 A * 3/1995 LePelley ..... B60D 1/18 280/292
6,047,433 A * 4/2000 Chang ..... A47K 7/022 15/222
7,959,046 B2 6/2011 Burnsed, Jr. et al.
8,430,285 B2 4/2013 Burnsed, Jr.
8,733,601 B2 5/2014 Burnsed, Jr.
9,146,074 B1 * 9/2015 McCarthy ..... F41C 23/02
(Continued)

FOREIGN PATENT DOCUMENTS

FR EP 2189748 A1 * 5/2010 ..... F41C 23/02

OTHER PUBLICATIONS

Machine Generated Translation (English) of European Patent Application No. EP2189748A1; Inventor: Salvador Jean Emile, Published: May 26, 2010. 8 pages.

*Primary Examiner* — Scott McNurlen
(74) *Attorney, Agent, or Firm* — St. Onge Steward Johnston & Reens LLC

(57) ABSTRACT

A sling for coupling a firearm to a user is disclosed. The sling comprises a front sling section having a front end and a rear end, a front connector located at the front end for connecting the front sling section to the firearm, and a front buckle having a handle that adjusts the length of the sling. The handle includes a first member extending outwardly from the front sling section and a second member transverse to first member, such that, when the second member is pulled in a first direction, the length of front sling section lengthens, and when the second member is pulled in a second direction, the length of the front sling section shortens. The sling further comprises rear sling section coupled to the front sling section and having a front portion and a rear portion, a rear buckle detachably coupling the front portion to the rear portion, a rear connector for connecting the rear sling section to the firearm, and a middle connector. The front connector releasably couples to the middle connector to form a loop.

18 Claims, 9 Drawing Sheets

(56) References Cited

U.S. PATENT DOCUMENTS

| | | | | |
|---|---|---|---|---|
| 2004/0188476 | A1* | 9/2004 | Johnson | F41C 33/002 224/150 |
| 2008/0265477 | A1* | 10/2008 | Staihar | A45C 13/001 267/113 |
| 2008/0302838 | A1* | 12/2008 | Burnsed, Jr. | F41C 23/02 224/150 |
| 2011/0055992 | A1* | 3/2011 | Roux | F41H 1/02 2/2.5 |
| 2011/0186603 | A1* | 8/2011 | Alford | F41C 33/00 224/150 |
| 2014/0203053 | A1* | 7/2014 | Rivas-Schlanger | F41C 33/002 224/150 |
| 2014/0215767 | A1* | 8/2014 | Ward | F41C 33/002 24/265 AL |
| 2015/0292834 | A1* | 10/2015 | McCarthy | F41C 33/002 224/150 |
| 2015/0292835 | A1* | 10/2015 | McCarthy | F16B 45/02 24/599.6 |

* cited by examiner

QUICK CONVERSION SLING

FIELD OF THE INVENTION

The present invention relates generally to the field of slings for carrying firearms, and specifically to an adjustable sling that can quickly convert between a single point configuration and a two point configuration.

BACKGROUND OF THE INVENTION

Traditionally, slings for firearms existed in a two point configuration or a single point configuration. In a two point configuration, the sling attaches to the weapon at two points, typically located near the front and the rear of the weapon. In a single point configuration, one end of the sling attaches to the rear of the weapon. The other end of the sling attaches to the sling itself near its connection to the weapon, forming a loop around the body of the user.

Single point and two point slings have complementary strengths and weaknesses. A single point configuration allows the user more maneuverability in handling the weapon. For example, the user can more easily transition from one shoulder to the other without hindrance from the front sling section of a two point configuration sling. The absence of a sling section near the front of the weapon for a single point configuration also facilitates the use of weapons that require actuating near the front, such as pump action shotguns. A single point configuration also offers more flexibility in confined spaces such as a car or narrow alleyways, as it allows the user to hold the weapon in a variety of convenient positions. Downsides of a single point configuration include the need to hold the weapon while moving to prevent the hanging weapon from interfering with the legs and gear of the user. Because at least one hand must be used to hold the weapon while active, the user is restricted in conducting activities that require two hands such as climbing a fence or apprehending a suspect.

A two point configuration sling, in contrast, allows the user to carry the weapon in a variety of positions, including on the sides, on the back, or even at the front. The weapon can be tightly secured to the body of the user, freeing the user's hands. Because it is more comfortable to wear, the two point configuration sling is also more suited for carrying weapons for longer treks, especially heavier weapons. However, a two point configuration sling does not allow the same freedom of quick movement with the weapon from a secure position as a single point sling. For example, it is more difficult to transition the weapon into a firing position or to switch shoulders with a two point configuration. This can dangerously compromise shooting readiness in combat situations.

Slings that convert between single point and two point configurations are known in the art. Convertible slings feature a connector at the front end that can be switched on the fly from a connection to the front of a weapon in two point configuration, to a connection to the rear of the sling in single point configuration. Some slings also feature adjustment buckles to lengthen or shorten the sling. Typically, the adjustment buckle is actuated with a tab that the user pulls to vary the size of the sling. Such tabs are typically made of a strap of nylon or similar material that protrudes from the adjustment buckle.

Traditional adjustment tabs present several challenges to users. The typical user of a firearm that requires a sling also wears a variety of gear, such as an ammunition belt, a backpack, or a load-bearing vest containing multiple items that may be bulky or cumbersome. Many of these items have straps of their own, and a typical adjustment tab of a sling can get visually lost in such gear and be difficult to immediately recognize. This can be critical in active situations if the user needs to rapidly locate and adjust the sling. The user's hold on a traditional tab can also be insecure if the tab is wet or slippery, for example during adverse weather conditions. An insecure hold on the adjustment tab can diminish the user's efficiency in adjusting the sling, wasting precious seconds in active situations.

While loop handles for slings exist that can provide a more secure hold on adjustment buckles, they present their own disadvantages. For example, such handles are even more prone to getting caught on other gear worn by the user or even onto features of the user's surroundings such as door handles, hooks, or other protrusions.

What is desired, therefore, is a sling for carrying a firearm that converts between a single point and a two point configuration, and that provides an adjustment buckle with an adjustment handle the user can immediately and positively recognize and securely grab in a variety of ways, even during adverse weather conditions. What is further desired is a convertible sling with an adjustable handle that will not interfere with the user's gear or surroundings.

SUMMARY OF THE INVENTION

In order to overcome the deficiencies of prior art and to achieve the objects and advantages listed, a sling for coupling a firearm to a user is disclosed. The sling comprises a front sling section having a front end and a rear end, a front connector located at the front end for connecting the front sling section to the firearm, and a front buckle having a handle that adjusts the length of the sling. The handle includes a first member extending outwardly from the front sling section and a second member transverse to first member, such that, when the second member is pulled in a first direction, the length of front sling section lengthens, and when the second member is pulled in a second direction, the length of the front sling section shortens. The length of the front section of sling is similarly adjusted when any part of the handle is pulled. The sling further comprises rear sling section coupled to the front sling section and having a front portion and a rear portion, a rear buckle detachably coupling the front portion to the rear portion, a rear connector for connecting the rear sling section to the firearm, and a middle connector. The front connector releasably couples to the middle connector to form a loop.

In some embodiments, the front connector is an HK-style snap hook. In other embodiments, the front connector has a thumb tab.

In certain advantageous embodiments, the front sling section further comprises a portion of strap. In some of these embodiments, the portion of strap couples to the front connector at one end and to the front buckle at another end, the front portion of strap looping through the front buckle before coupling to the front buckle. In other of these embodiments, the front portion of strap is threaded through a plurality of glides. In additional of these embodiments, the portion of strap loops through a ring element coupling the front sling section to the rear sling section. In further embodiments, the portion of strap is secured to the front buckle using a box stitch pattern.

In some embodiments, the first member comprises a first piece of strap material looped around a bar of the front buckle and stitched together, and the second member comprises a second piece of strap material folded over and stitched to the ends of the first piece of strap material, the first and second pieces of strap material being orthogonal to each other.

In certain embodiments, the front portion is a portion of strap at least 36" long. In some of these embodiments, the sling further comprises a padded section located along the front portion. In some of these embodiments, the padded section consists of 2" piece of outer tube shorter than the portion of strap and wrapped around the portion of strap, the space between the portion of strap and the piece of outer tube being filled with ¼" foam, and each end of the outer tube being stitched to the portion of strap.

In some embodiments, the rear buckle is a side release buckle having a male end and a female end.

In other embodiments, the sling further comprises a short portion of strap having two ends, the short portion of strap looping through a rear end of the middle connector and through a front end of the rear buckle, the ends of the short portion of strap being folded onto the middle of the short portion of strap to form three layers of strap, the three layers of strap being stitched together.

In certain embodiments, the sling further comprises a short portion of strap having two ends, the short portion of strap looping through a rear end of the rear buckle and through a front end of the rear connector, the ends of the short portion of strap being folded onto the middle of the short portion of strap to form three layers of strap, the three layers of strap being stitched together.

In some embodiments, the rear connector is an HK-style snap hook.

In some embodiments, the middle connector comprises two mounts for coupling with the front connector. In some of these embodiments, the two mounts are located on opposite ends of the middle connector. In others of these embodiments, the two mounts are apertures.

DETAILED DESCRIPTION OF THE INVENTION

Figure 1:
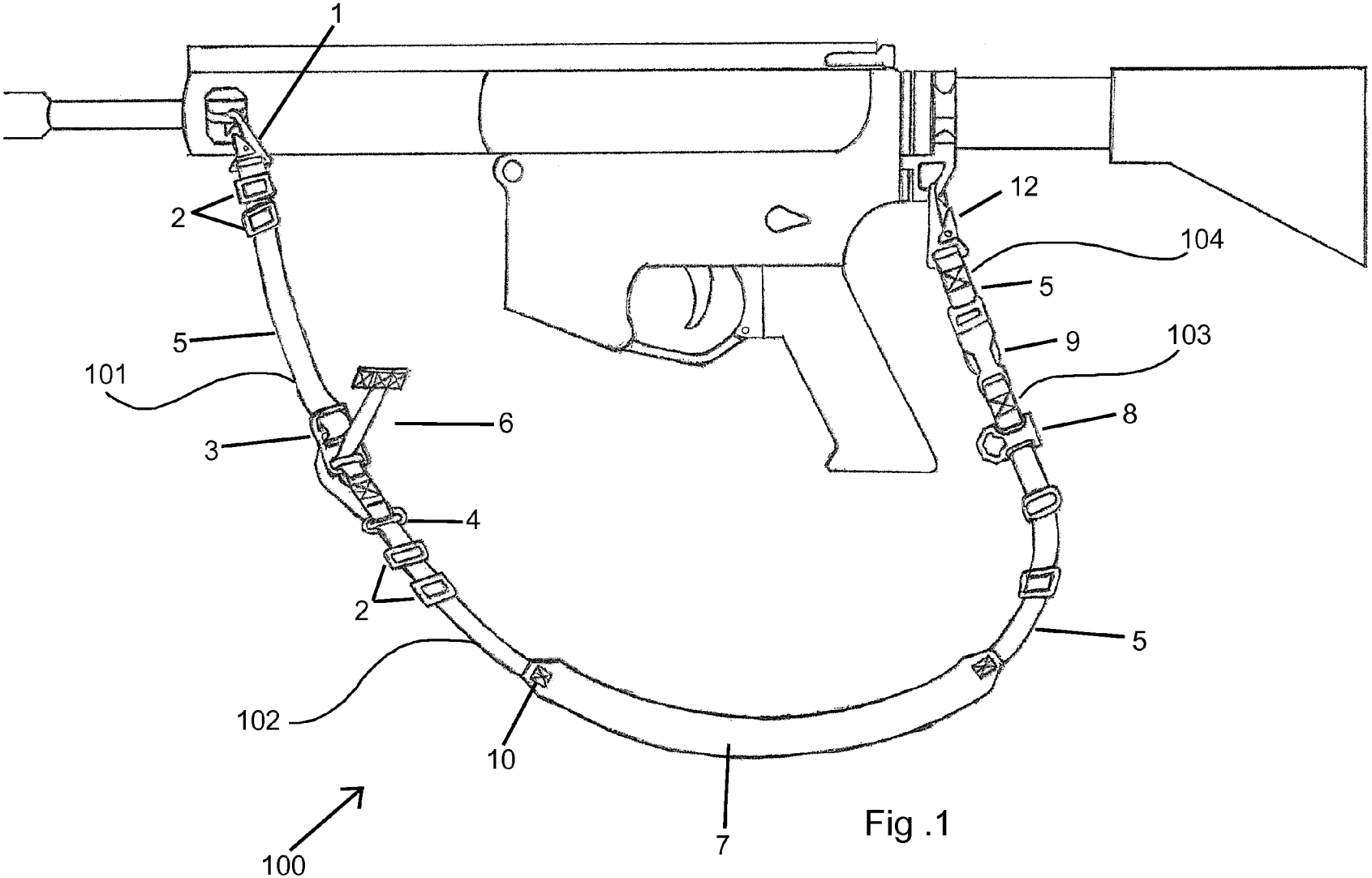
FIG. 1 is a side view of a quick conversion sling attached to a firearm in a two point configuration.
Figure 2B:
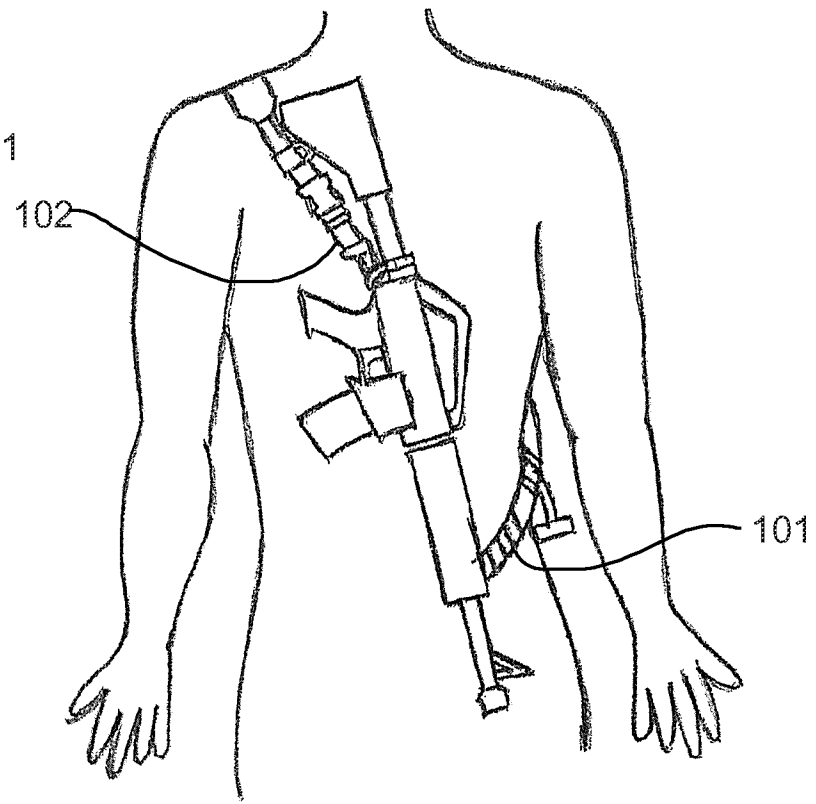
FIG. 2B is a front view of a user wearing the quick conversion sling with a firearm in a two point configuration.
Figure 2A:
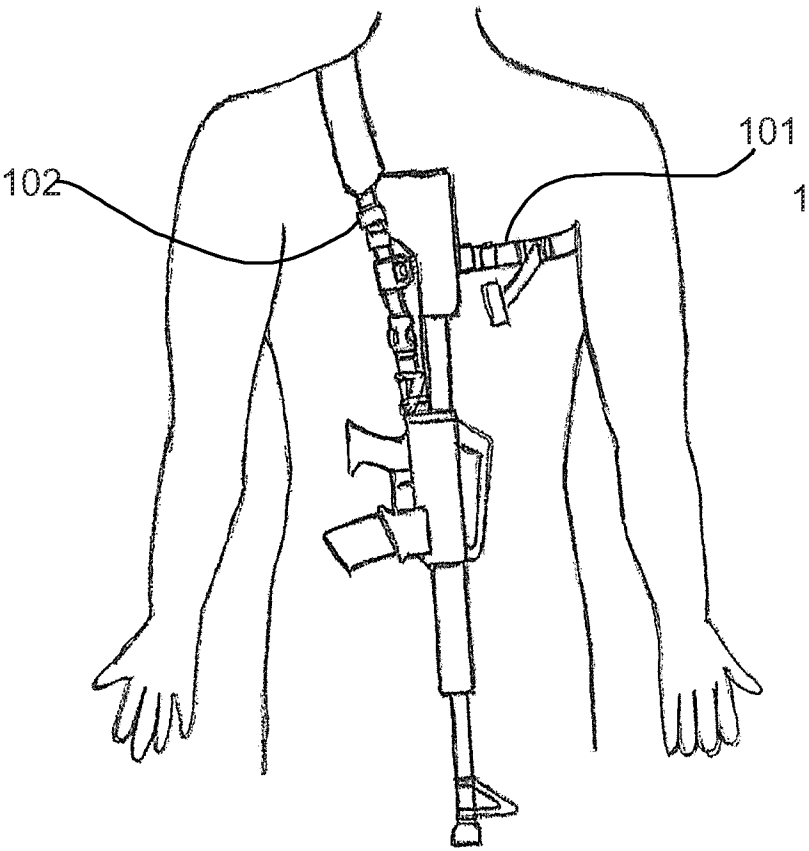
FIG. 2A is a front view of a user wearing the quick conversion sling with a firearm in a single point configuration.

As shown in FIG. 1, the quick conversion sling (100) consists of two sections: a front sling section (101) and a rear sling section (102). The sling (100) can be used in a two-point configuration or a single-point configuration. In the two-point configuration shown in FIG. 2B, the end of the front sling section (101) couples to a sling mount located near the front end of a weapon. In a single point configuration, illustrated in FIG. 2A, the same end of the front sling section (101) connects to the rear sling section (102) to form a loop around the body of the user. As will be described below, the design and components of the sling allow the user to convert quickly and easily between both configurations.

Figure 3:
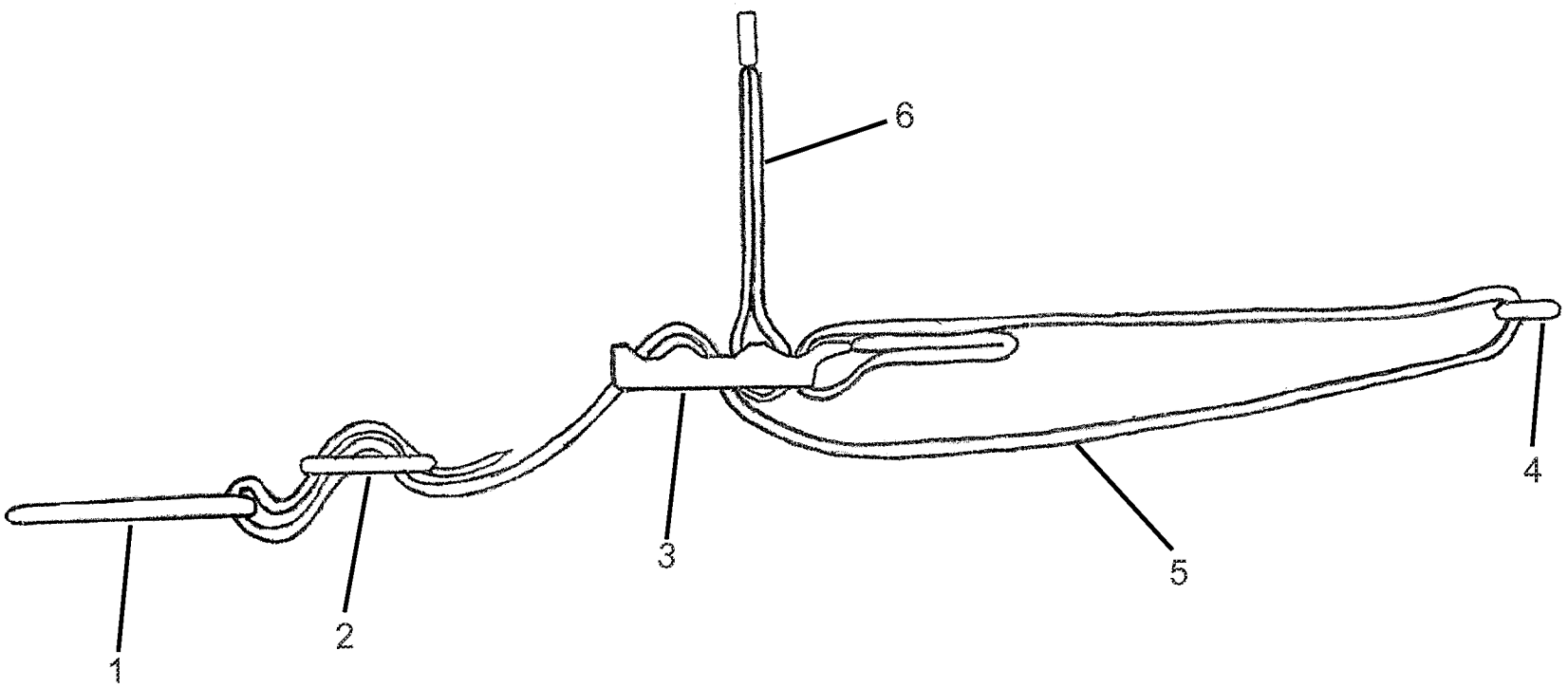
FIG. 3 is a side view of the front sling section.

The front sling section is illustrated in detail in FIG. 3. The section includes a front connector (1), glides (2), a front buckle (3), a ring element (4), a portion of strap (5), and a T-handle (6).

The front connector (1) is used to attach the front end of the sling to the front of the weapon in two point configuration. In single point configuration, the front connector (1) is coupled to the rear sling section (102). The front connector (1) may be any number of commercially available connectors suitable for securing a sling to a weapon. In the embodiment shown in FIG. 3, the front connector (1) is an HK-style snap hook.

Figure 4B:
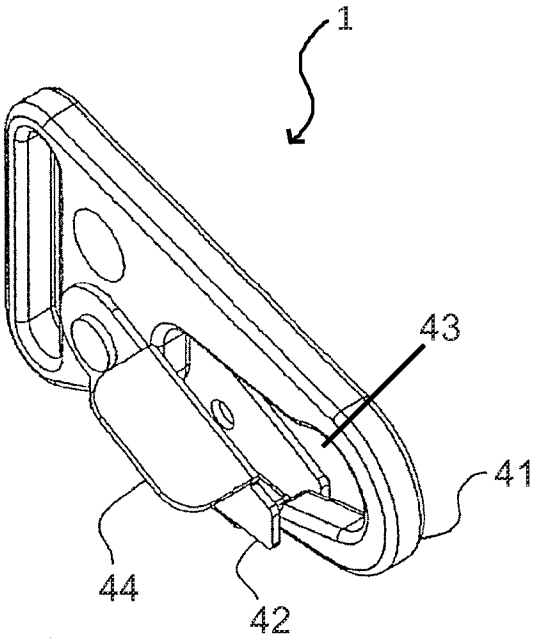
FIG. 4B is a perspective view of a snap hook connector with a thumb tab.
Figure 4A:
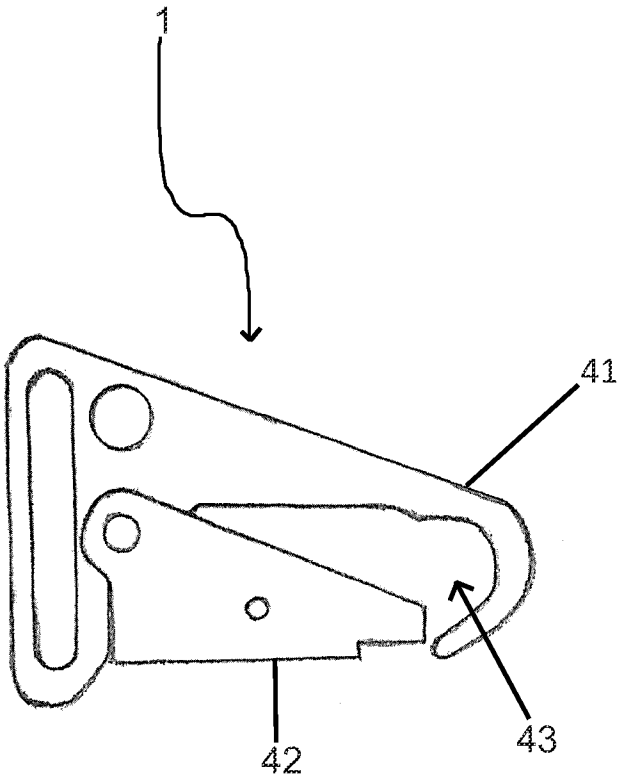
FIG. 4A is a side view of an HK-style snap hook connector.

FIG. 4A illustrates the HK-style snap hook in greater detail. The HK-style snap hook includes a hook (41) and a lever (42) that opens and closes to form a loop (43) in the hook. The lever (42) typically includes a spring that compresses when a user applies pressure inward to open the snap hook. When the user releases the pressure, the lever (42) returns to a closed position and the loop (43) reforms with the hook (41). This ensures that the snap hook will remain closed and locked around the hook attachment on the weapon. Because it is a heavy-duty snap hook that is unlikely to inadvertently disengage from the weapon to which it is latched, the HK-style snap hook is particularly suited for releasably coupling a sling to a weapon.

In other embodiments illustrated in FIG. 4B, the snap hook includes a thumb tab (44). A thumb tab snap hook offers several advantages over a traditional snap hook. During operation of a traditional snap hook, the user's thumb can sometimes interfere with the hook (41) of the snap hook. This interference slows the lever (42)'s opening and reduces efficiency. Moreover, users of weapons and thus slings such as the quick conversion sling commonly wear gloves, highlighting another shortcoming of traditional snap hooks. Gloves increase the surface area of the fingers and reduce dexterity. Since the lever on a traditional snap hook is narrow, a gloved hand can struggle to operate the hook without the fingers interfering with the latching or unlatching process. Glove material can also catch on to the snap hook's lever or hook, causing further delay. A thumb tab (44) located outside the area in which the lever (42) moves prevents interference between the user's thumb and the hook (41) during operation of the snap hook. Eliminating this interference facilitates latching the hook to or unlatching it from, loop-style mounts such as those located on the front end of the weapon in a two-point configuration, or on the rear sling section in a single-point configuration.

As illustrated in FIG. 3, the front connector (1) is coupled to a portion of strap (5). The portion of strap (5) loops through a mounting aperture of the front connector (1) to secure the front connector (1) to the portion of strap (5). The portion of strap (5) is a piece of fabric sufficiently small to fit into the mounting aperture of the front connector (5), and large enough to support the weight of the weapon and the force it exerts on the sling during active situations. The portion of strap (5) may be made of a strong, smooth, and durable natural material such as leather or cotton webbing, or a synthetic material such as neoprene or nylon. In the embodiment shown, the portion of strap is made of 1" nylon piece approximately 36" inch in length. It is understood that the dimensions of the portion of strap may vary with the design of the sling. The portion of strap (5) connects to a front buckle (3).

Figure 5B:
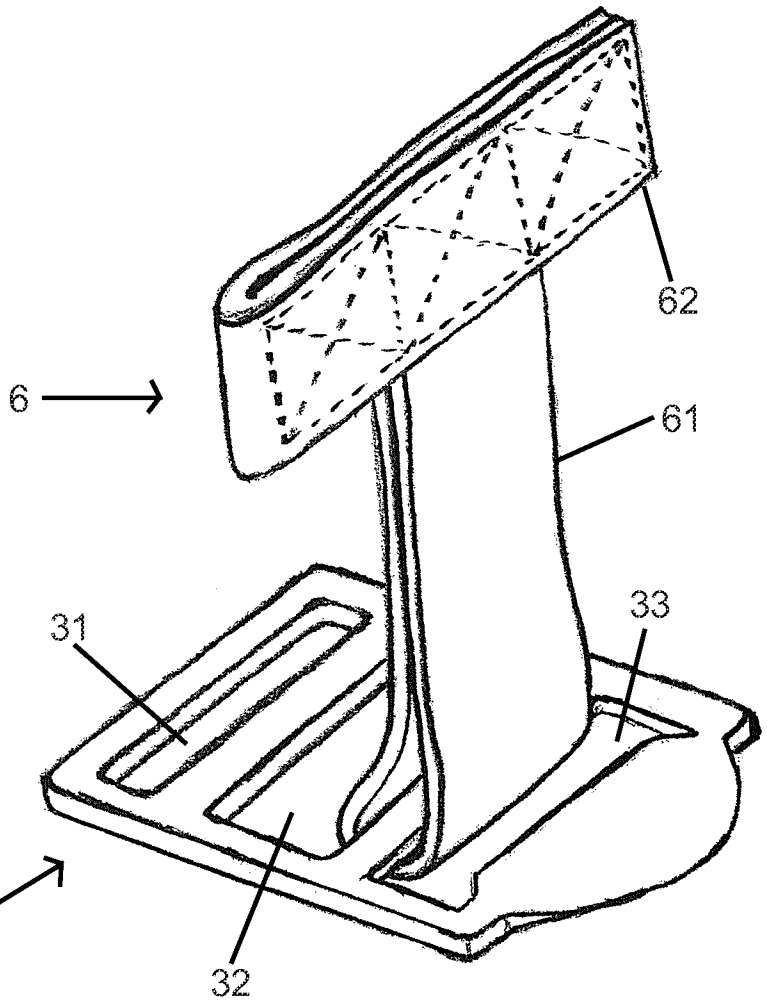
FIG. 5B is a perspective view of the adjustment buckle with a T-handle.
Figure 5A:
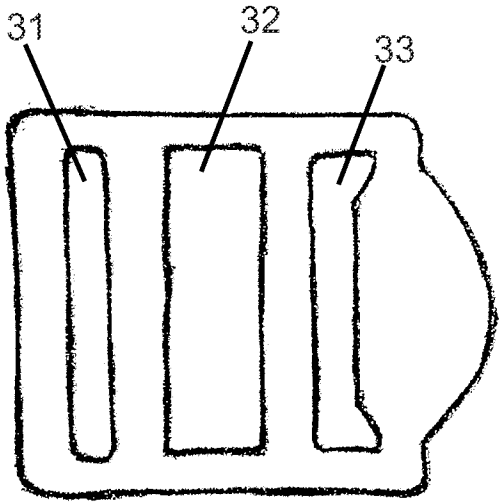
FIG. 5A is a top view of the adjustment buckle.

The front buckle (3) allows the user to adjust the length of the sling by pulling on an adjustment tab (6). Thus, the front buckle (3) is also an adjustment buckle (3). Referring back to FIG. 3, as well as FIGS. 5A and 5B, the adjustment buckle (3) is a metal piece of generally rectangular or square shape. Two parallel metal bars join the sides of the rectangle, forming three apertures (31, 32, 33). The rear end of the front portion of strap (5) first loops through the adjustment buckle (3), up via the first aperture (31), then around the front inner bar and back down the second aperture (32). The portion of strap (5) then loops through a ring element (4) before connecting back to the rear end of the adjustment buckle (3). The strap is secured to the rear end of the adjustment buckle (3) by looping around an outer bar of the buckle and through aperture (33), before getting stitched onto itself. In the embodiment shown, the strap is secured by two bar tack stitches and one "box x" stitch centered between the two bar tack stitches. This stitching pattern ensures that the strap is securely connected to the adjustment buckle, and the connection can withstand the larger load of heavier weapons. It should be noted that other stitching patterns or means of securing the portion of strap to the buckle are suitable as long as long as they provide a connection strong enough for heavy weapons.

A handle (6) protrudes from the top side of the adjustment buckle (3). The handle is used to pull the adjustment buckle (3) along the portion of strap (5) to adjust the size of the sling. In some embodiments such as one illustrated in FIG. 5B, the handle is a T-handle. A T-handle is a handle shaped like the letter "T," with the base of the "T" connected to the second inner bar of the adjustment buckle (3). The T-handle (6) is built with a similar or same material as the portion of strap (5). In some embodiments, the T-handle (6) is made of nylon. In such embodiments, the T-handle consists of two pieces of 1" nylon corresponding to the leg of the "T" (61) and the bar of the "T" (62). One end of the "leg" piece of nylon (61) is looped under a bar of the adjustment buckle (3) and folded back up and together with the other end. Both ends of the piece of nylon are then stitched together from their ends to the bar of the adjustment buckle (3). Typically, this piece of nylon is approximately 10" long, resulting in a 5" length for the leg (61) of the "T". A second piece of 1" nylon (62) approximately 6" long, is folded over the ends of the first piece of nylon and orthogonally to it, to form the bar (62) of the "T" measuring approximately 3". The second piece is then stitched to the first piece, resulting in a T-handle (6).

The T-handle offers several advantages over other types of handles that are known in the art. The T-handle provides a more secure hold than a traditional adjustment tab. Indeed, the bar of the T-handle helps prevent the handle from slipping through the hand when the handle is pulled. This allows the user to wear the sling and operate the handle when it is wet or otherwise slippery, such as during adverse weather conditions. The T-handle also improves on other types of handles because it allows the user immediate and positive tactile or visual recognition of the handle among the many other items that may encumber the user wearing the sling. Many of these items may include strap-like elements or even be worn with their own slings.

The T-handle also improves upon loop handles. Unlike a loop handle, which requires the user to find and insert one of more fingers into the loop from a specific direction in order to properly pull the handle, the T-handle can be grabbed from any direction or angle, and does not require the dexterity of inserting fingers or a hand into a loop. Eliminating the requirement to approach the handle from a limited set of directions substantially speeds up the operation of the adjustment tab. This is particularly useful for users wearing gloves, which can restrict dexterity.

It is also easier and faster to let go of a T-handle than a loop handle. Whereas the user merely has to open his hand to release the handle, a user who has inserted his fingers into a loop handle may have to extricate such fingers out of the loop in order to free his hand, wasting valuable time. This time can be critical in combat situations. The design of the T-handle also ensures that, unlike a loop handle, no gear will inadvertently get caught in the handle and interfere with the sling. Thus, a T-handle offers both the reliable grip of a loop handle and the ease of use of a tab.

The adjustment buckle (3), T-handle (6), and portion of strap (5) are configured to shorten or extend the length of the sling depending on the direction into which T-handle (6) is pulled. Thus, for a user wearing the sling, pulling the T-handle (6) toward the user lengthens and loosens the sling. In contrast, pulling the T-handle (6) away from the body of the user shortens the sling and tightens it around the user. The length can be adjusted while the sling is worn in single-point configuration or two-point configuration, or even when the sling is not worn.

Referring back to FIG. 3, glides (2) are attached to the front portion of strap (5) and located between the front connector (1) and the adjustment buckle (3). The glides (2) allow the user to adjust the length of the portion of strap (5). In the embodiment shown, the glides are heavy duty acetyl glides. However, any other type of glides can be used.

The ring element (4), through which the portion of strap (5) is looped before connecting to the adjustment buckle (3), completes the front sling section (101). The ring element (4) serves to connect the front sling section (101) to the rear sling section (102). In the embodiment shown, the ring element (4) is a standard metal oval loop. However, any other type of ring element can be used to join the front sling section (101) and rear sling section (102), provided it is sufficiently strong to withstand the load of a heavy weapon.

The rear sling section (102) has two portions: a front portion (103) and a rear portion (104). As shown in FIG. 1, the front portion (103) consists of a long portion of strap (5) that starts at ring element (4), includes a single point attachment connector (8), and terminates at a rear buckle or quick release buckle (9). The quick release buckle (9) serves to detachably couple the front portion (103) and the rear portion (104) of the rear sling section (102).

Figure 6:
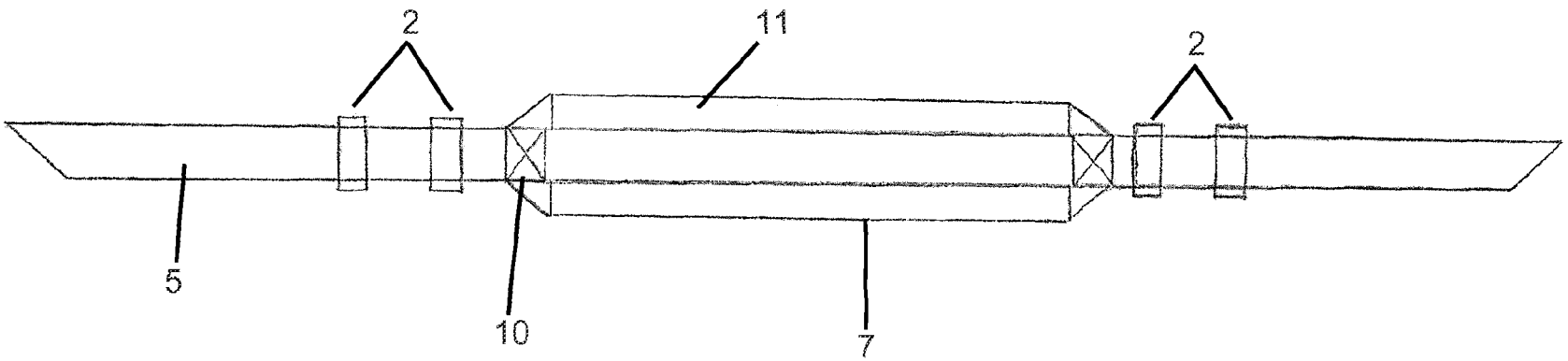
FIG. 6 is a front view of the padded section of the sling.

As shown in the FIG. 6, the front portion (103) begins with a portion of strap (5). In the embodiment shown, the portion of strap (5) is a 1" nylon piece approximately 50" long. Preferably, the piece of nylon is identical in type to the front portion of strap of the front section of the sling. At the front end of the portion of strap (5), the strap is looped through the ring element (4) and threaded back through a set of glides (2). The glides (2) ensure that that connection of the portion of strap (5) to the ring element (4) is secure, while also providing for lengthening or shorting the portion of strap (5). Similarly, at the rear end of the portion of strap (5), glides (2) help secure the strap to the single point attachment connector (8) and provide for a means of adjusting the length of the sling (100).

In some embodiments, the front portion (103) of the rear sling section (102) includes a padded section as illustrated in FIG. 6. The padded section is located near the middle of the front portion (103) and is attached to the portion of strap (5) on both sides. This location ensures that the padded section is situated generally at or near the middle of the sling (100). The padded section of the sling is intended to rest on the shoulder or the base of the neck of the user, and helps reduce any discomfort from wearing the sling.

Referring to FIG. 6, the portion of strap (5) is slipped into a shorter but wider 2" tubular piece of strap (7) to form the padded section of the sling. In the embodiment shown, the outer tube (7) is a 2" tubular nylon piece of approximately 18" in length. Between the outer nylon tube (7) and inner nylon portion of strap (5) is a piece of soft material (11) that serves as a padding and dampening material for the padded section. The padding (11) runs through the length of the outer tube (7). In the embodiment shown, the padding (11) is a piece of ¼" foam. However, any other light padding material can be used. The outer tube (7) is stitched to the portion of strap at both ends using box stitch patterns (10).

As noted above, portion of strap (5) of the front portion (103) connects to a single point attachment connector, or middle connector (8). The single point attachment connector (8) has a mount where the front connector (1) detachably couples to form a loop in single point configuration. In the embodiment shown in FIG. 7B, the single point attachment connector (8) consists of a metal plate of generally rectangular shape but with one convex short side. An aperture (81, 82) runs the length of each of the long sides and allows the insertion of a portion of strap. This allows the single point attachment connector to couple with portions of strap on both sides. The mount for the front connector (1) is a wider aperture (83) located near a short side of the single point attachment connector (8), giving that side its convex shape. The front connector of the sling thus couples with the single point attachment connector (8) through this aperture (83).

In some embodiments, the single point attachment connector (8) features two mounts for coupling with the front connector (1). Typically, the mounts are located on opposite sides of the connector (8), as shown in FIG. 7C, where the mounts are two apertures (83, 84). The two appertures provide more flexibility for ambidextrous use of the sling in single point configuration. Thus, for left-hand operation, the sling rests on the left shoulder of the user, with the front section of the sling looping under the right arm of the user before coupling with the right side of the single point attachment connector. Similarly, for right-hand operation, the sling rests on the right shoulder, and the front connector is brought under the left arm of the user to couple to the left side of the single point attachment connector. The greater flexibility provided by this type of single attachment connector facilitates the use of the sling by users who favor one side because of preference, injury or disability, as well as users who prefer or need the ability to easily and comfortably switch sides in single point configuration.

The single point attachment connectors (8) shown above are configured to couple with hook type connectors such as the HK-style snap hook (1) and thumb tab hook (1), also disclosed above in this specification. However, other types of single point attachment connectors can be used, provided that they match with the front connector to secure a reliable attachment for single point configuration.

Figure 7A:
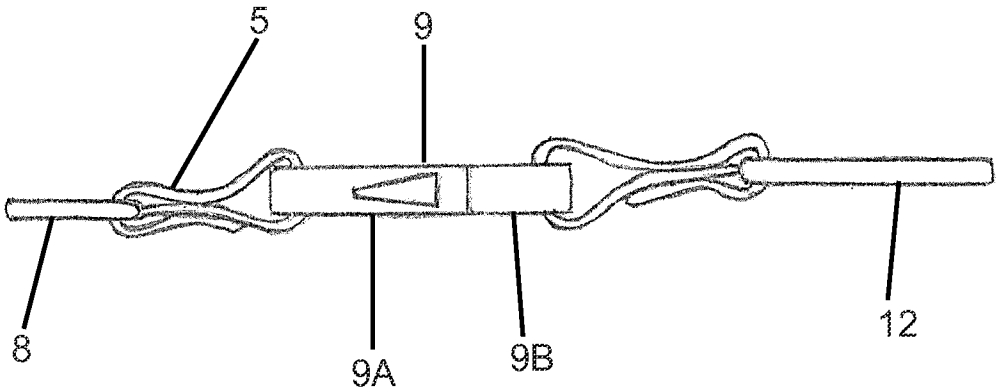
FIG. 7A is a side view of the rear portion of the rear sling section.
Figure 7B:
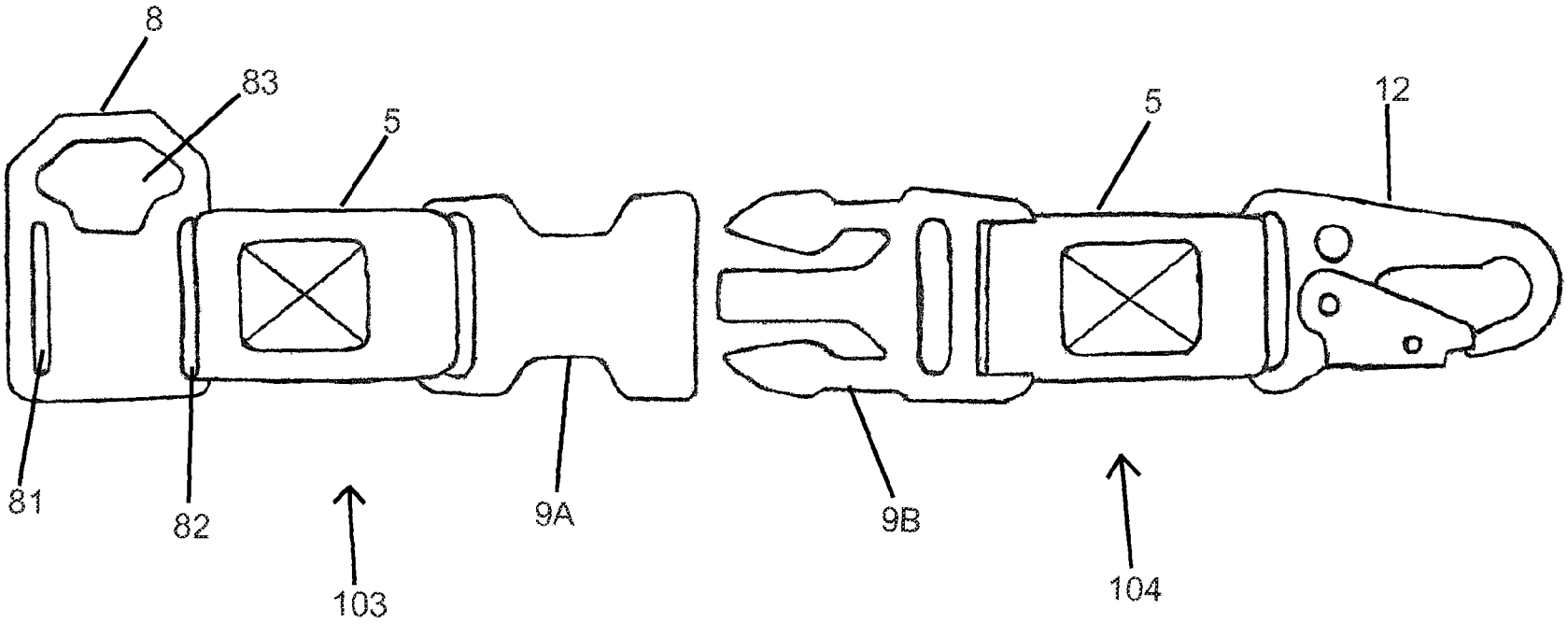
FIG. 7B is a top view of the rear portion of the rear sling section.
Figure 7C:
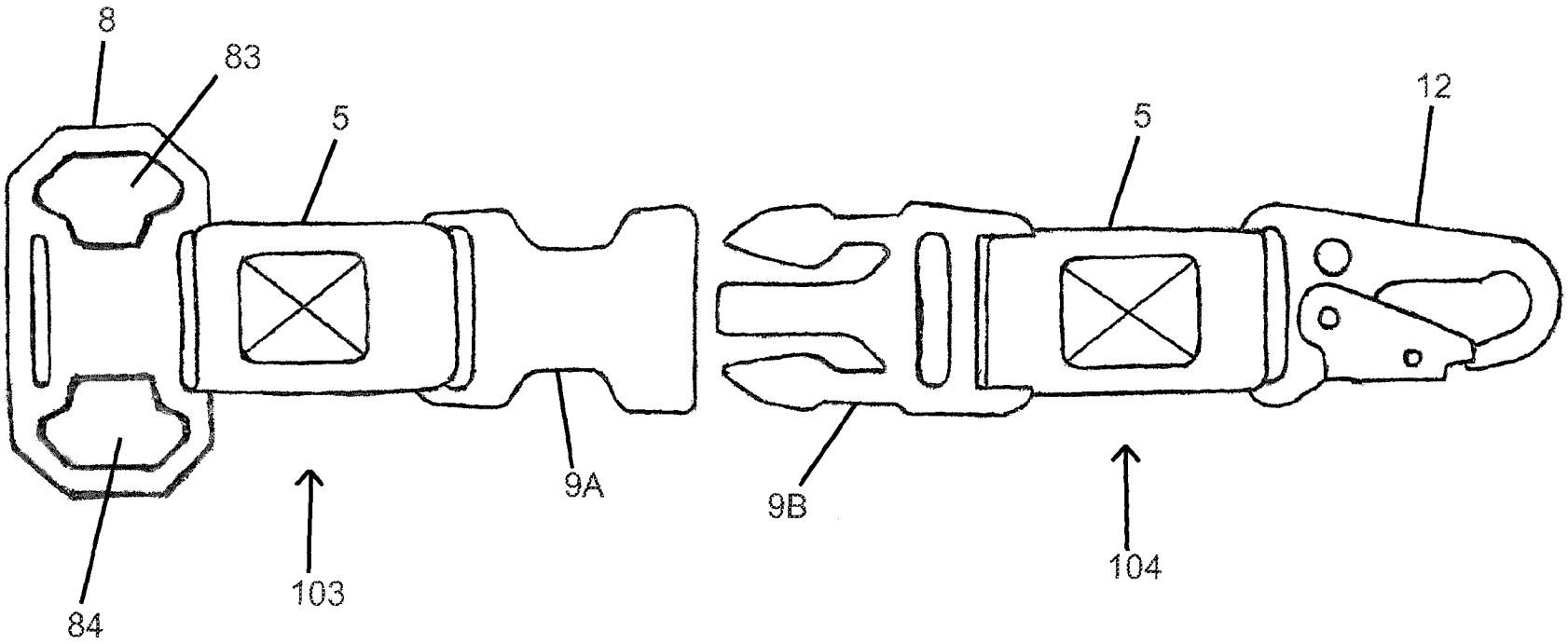
FIG. 7C is a top view of the rear portion of the rear sling section with a middle connector having two mounts.

As shown in FIGS. 7A-C, the rear side of the single point attachment connector is coupled to the front side of a quick release buckle (9) via a short portion of strap (5). Typically, the portion of strap (5) that links the single point attachment connector and the quick release buckle (9) is a piece of 1" nylon looped through both the rear aperture (82) of the single point attachment connector (8) and an aperture of the front end of the quick release buckle (9). Both ends of the portion of strap are then folded back onto the center of the portion of strap, creating a triple layer of strap. The triple layer is then stitched together using a box stitch pattern. The box stitch pattern ensures a secure connection that can withstand the load of heavy weapons. It is understood that any other stitching pattern or means of attaching the portion of sling to the female connector of the quick release buckle is appropriate so long as it ensures that the connection is sufficiently strong to withstand larger weapons.

The quick release buckle (9) joins the front portion (103) to the rear portion (104) in the rear sling section (102). The buckle is a two-piece connector that allows the user to quickly uncouple the rear portion (104) from the front portion (103) in single-point configuration, leaving the rear portion (104) attached to the weapon, while the loop formed by the front portion (103) and the front sling section (102) is left attached to the user's body. For this reason, one piece of the buckle (9) terminates the front portion (103), and the other piece begins the rear portion (104).

FIGS. 7A-C show an exemplary quick release buckle (9) suitable for embodiments of the invention. In this embodiment, the quick release buckle is a commercially available heavy duty acetyl side release buckle. However, any other type of quick release buckle is suitable provided it is strong, durable, and quick to disconnect, as is critical during tactical engagements. The buckle consists of a female member (9A) and a male member (9B). In the embodiment shown, the female member (9A) terminates the front portion (103) of the rear section (102) of the sling, whereas the male member (9B) begins the rear portion (104) of the rear section (102) of the sling. While this specification will maintain this orientation for descriptive purposes, it is understood that the reverse orientation for buckle (9) is equally suitable for the sling.

To join the front portion (103) and the rear portion (104), the male member (9B) of buckle (9) snaps into the female member (9A), ensuring a strong connection between the two portions. When the buckle is snapped in, sufficient pressure on both edges of the interlocked end of the male member (9B) unlocks and disconnects that member from the female member (9A). This disconnects the rear portion (104) from the rest of the sling. When this action is performed during single point mode, the weapon uncouples from the sling, which stays on the user.

The male member (9B) of the quick release buckle (9) begins the rear portion (104). A short portion of strap connects this male end (9B) of the buckle (9) to a rear connector (12). This portion of strap is configured similarly to the portion of strap connecting the female end (9A) of the quick release buckle to the single point attachment connector (8), and serves the same function. Thus, in the embodiment shown in FIGS. 7A-C, the portion of strap (5) is a piece of 1" nylon a few inches long. One end of the strap loops through the connecting aperture at the male end (9B) of the quick release buckle (9), while the other loops through the connection aperture of a rear connector (12). As between the single point attachment connector (8) and the female end (9A) of the quick release buckle (9), both ends of the portion of strap (5) are then folded back onto the center of the portion of strap (5), creating a triple layer of strap. The triple layer is then stitched together using a box stitch pattern. The box stitch pattern ensures a secure connection that can withstand the load of heavy weapons. Similarly to the aforementioned portion of strap between the single point attachment connector (8) and the quick release buckle (9), it is understood that any other stitching pattern or means of attaching the portion of sling between the quick release buckle (9) and the rear connector (8) is appropriate so long as it ensures that the connection is sufficiently strong to withstand the load of heavy weapons.

The rear connector (12) terminates the rear portion (104) and thus the sling, and serves to couple it to a weapon. Typically, the rear connector couples to a corresponding sling mount located near the rear of the weapon. Like the front connector (1) of the sling, the rear connector (12) can be any number of commercially available connectors. In the embodiment shown, the rear connector (12) is a snap-hook type connector such as disclosed for the front connector (1). A snap-hook connector allows the user to easily couple the rear end of the sling to the weapon.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A sling for coupling a firearm to a user, the sling comprising:

a front sling section having a front end and a rear end, a front connector located at the front end for connecting the front sling section to the firearm, and a front buckle having a handle that adjusts the length of the sling;

wherein the handle includes a first member extending outwardly from the front sling section and a second member transverse to the first member, such that, when the second member is pulled in a first direction, the length of the front sling section lengthens, and when the second member is pulled in a second direction, the length of the front sling section shortens; and a rear sling section coupled to the front sling section and having a front portion and a rear portion, a rear buckle detachably coupling the front portion to the rear portion, a rear connector for connecting the rear sling section to the firearm, and a middle connector;

wherein the front connector releasably couples to the middle connector to form a loop;

wherein the first member comprises a first piece of strap material looped around a bar of the front buckle and stitched together, and the second member comprises a second piece of strap material folded over and stitched to the ends of the first piece of strap material, the first and second pieces of strap material being orthogonal to each other and forming the shape of the letter "T".

2. The sling of claim 1, wherein the front connector is a snap hook comprising a hook and lever.

3. The sling of claim 1, wherein the front connector has a thumb tab.

4. The sling of claim 1, wherein the front sling section further comprises a portion of strap.

5. The sling of claim 4, wherein the portion of strap couples to the front connector at one end and to the front buckle at another end, the portion of strap looping through the front buckle before coupling to the front buckle.

6. The sling of claim 4, wherein the portion of strap is threaded through a plurality of glides.

7. The sling of claim 4, wherein the portion of strap loops through a ring element coupling the front sling section to the rear sling section.

8. The sling of claim 5, wherein the portion of strap is secured to the front buckle using a box stitch pattern.

9. The sling of claim 1, wherein the front portion comprises a portion of strap at least 36" long.

10. The sling of claim 9, further comprising a padded section located along the front portion.

11. The sling of claim 10, wherein the padded section comprises a 2" piece of outer tube shorter than the portion of strap and wrapped around the portion of strap, the space between the portion of strap and the piece of outer tube being filled with ¼" foam, and each end of the outer tube being stitched to the portion of strap.

12. The sling of claim 1, wherein the rear buckle is a side release buckle having a male end and a female end.

13. The sling of claim 1, further comprising a short portion of strap having two ends, the short portion of strap looping through a rear end of the middle connector and through a front end of the rear buckle, the ends of the short portion of strap being folded onto the middle of the short portion of strap to form three layers of strap, the three layers of strap being stitched together.

14. The sling of claim 1, further comprising a short portion of strap having two ends, the short portion of strap looping through a rear end of the rear buckle and through a front end of the rear connector, the ends of the short portion of strap being folded onto the middle of the short portion of strap to form three layers of strap, the three layers of strap being stitched together.

15. The sling of claim 1, wherein the rear connector is a snap hook comprising a hook and lever.

16. The sling of claim 1, wherein the middle connector comprises two mounts for coupling with the front connector.

17. The sling of claim 16, wherein the two mounts are located on opposite ends of the middle connector.

18. The sling of claim 16, wherein the two mounts are apertures.

* * * * *